United States Patent [19]

Merkle

[11] Patent Number: 4,475,470

[45] **Date of Patent: * Oct. 9, 1984**

[54] SUSPENDED ROOF CONSTRUCTION FOR INDUSTRIAL FURNACES

[75] Inventor: Frank P. Merkle, Hanover, Ill.

[73] Assignee: Merkle Engineers, Inc., Galena, Ill.

[ * ] Notice: The portion of the term of this patent subsequent to Jan. 10, 2001 has been disclaimed.

[21] Appl. No.: 456,629

[22] Filed: Jan. 10, 1983

Related U.S. Application Data

[63] Continuation-in-part of Ser. No. 344,515, Feb. 1, 1982, Pat. No. 4,424,756.

[51] Int. Cl.[3] ..... F23M 5/02

[52] U.S. Cl. ..... 110/332; 110/338; 110/339; 52/636

[58] Field of Search ..... 110/338, 339, 331, 332; 432/247, 248, 251, 252; 52/761, 632, 485

[56] References Cited

U.S. PATENT DOCUMENTS

| | | | |
|---|---|---|---|
| 1,173,862 | 2/1916 | Reilly | 110/332 |
| 1,402,482 | 1/1922 | Davis | 110/339 |
| 1,563,248 | 11/1925 | Burroughs | 110/332 |
| 2,155,165 | 4/1939 | Hener | 110/332 |
| 2,840,017 | 6/1958 | Wolf | 110/339 |
| 2,982,237 | 5/1961 | Copeland et al. | 110/339 |
| 3,400,672 | 9/1968 | Dickson | 110/332 |
| 3,824,936 | 7/1974 | Merkle, Jr. | 110/338 |
| 3,900,182 | 8/1975 | Berman et al. | 52/632 |
| 4,073,243 | 2/1978 | Merkle, Jr. | 110/339 |
| 4,248,024 | 2/1981 | Dahlstrom | 52/636 |

FOREIGN PATENT DOCUMENTS

| | | | |
|---|---|---|---|
| 1152718 | 8/1963 | Fed. Rep. of Germany | 110/339 |

*Primary Examiner*—Henry C. Yuen

*Attorney, Agent, or Firm*—Thomas W. Speckman

[57] ABSTRACT

A refractory brick panel module and suspended roof construction for high temperature furnaces wherein the panel module has a refractory support frame of at least two substantially parallel support members with at least one end of the support members having extension and retraction means forming an extendable and retractable refractory support frame end portion. The refractory support frame end portion in retracted position allows passage of the refractory support frame between adjacent roof support beams and in extended position provides refractory brick suspension beneath the roof support beams to a proximity to adjacent roof panel modules. The extendable and retractable refractory support frame allows great flexibility in modular suspended roof construction, providing easy repair of either entire modules or replacement of a relatively small number of refractory bricks from the cold side of the furnace roof.

24 Claims, 7 Drawing Figures

SUSPENDED ROOF CONSTRUCTION FOR INDUSTRIAL FURNACES

CROSS REFERENCE TO RELATED APPLICATION

This application is a continuation-in-part of my earlier copending application Ser. No. 344,515, filed Feb. 1, 1982, U.S. Pat. No. 4,424,756.

BACKGROUND OF THE INVENTION

This invention relates to suspended roof construction for industrial furnaces, and more particularly to a roof of suspended refractory bricks having a modular panel construction. The roof construction of this invention may be preassembled exterior to the furnace in panels which may be lowered between spaced support beams and the panel framework extended for suspension of refractory bricks beneath the support beams after installation. The panelized roof construction provides utilization of different type refractory bricks in different portions of a furnace or in different portions of a single panel. The panelized construction makes possible easy replacement of entire sections of the suspended roof and easy replacement of as few as two suspended refractories.

The suspension of refractory bricks in the roof construction of high temperature industrial furnaces is disclosed in U.S. Pat. Nos. 3,824,936 and 4,073,243 which are incorporated herein by reference in their entirety. Prior art suspended roof designs have not provided roof structures as easy to construct or as easy to maintain and repair as desired.

U.S. Pat. No. 3,824,936 describes a roof construction wherein a plurality of basic refractory brick assembly units depend downwardly from hangers which are suspended from a suitable frame. Each assembly unit has a carrier brick having a reduced head portion and a body portion. The reduced head portion is provided with a hole through which an elongated rod extends holding adjacent carrier bricks. The elongated rod is hung on the hangers which extend between the reduced head portions of adjacent carrier bricks. Two filler bricks may be supported by each carrier brick. This construction results in recesses and unevenness on the top surface, or cold face, which is difficult to clean and requires removal of relatively large sections for repair.

In the roof construction shown in U.S. Pat. No. 4,073,243, refractory bricks are suspended from hanger rods which are secured in recesses in one side of the bricks. One hanger rod is required for each pair of bricks making replacement of a small number of bricks easy, but is undesirable for an entire roof because each rod is an obstacle to cleaning. The roof construction of the '243 patent does provide a flat cold face.

There is a need for a suspended roof construction for high temperature furnaces which may be easily constructed and repaired and provides a substantially flat, unobstructed, easy cleaning cold surface.

It is desirable to assemble refractory bricks in panel units and a plurality of such panel units desirably provide support for refractory bricks for the entire furnace roof, including beaneath the support beams. When replacement of a section of the furnace roof is required, the panel may be removed and repaired away from the furnace and replaced. It is desirable to remove and replace the panels from the cold side of the roof, so that the furnace need not be completely shut down to effect the repairs. This has been difficult with prior panelized furnace roof construction which has required separate support structure beneath the support beams.

It is desirable to assemble refractory bricks in panels wherein the same panel frame structure may be used for different types of refractory bricks and different types of refractory bricks may be used in the same panel. This is advantageous where part of a roof panel is subject to severe wear and it is desired to provide easy replacement for only a few refractory bricks.

Furnace roof panels have refractory bricks suspended from support means including a support frame for suspending the bricks and which is suspended from panel module support beams which rest upon roof support beams. The roof panels and their support frame must be shorter than the space between adjacent roof support beams so that the panel module may be lowered between the roof support beams for installation, and raised between the roof support beams for removal and repair. However, such roof panels do not fill the area of the roof construction below the roof support beams and the areas between adjacent roof panels must be filled with bricks which have previously required construction of separate support structure.

SUMMARY OF THE INVENTION

The present invention relates to suspended roof construction for high temperature furnaces having a plurality of roof panel modules of refractory bricks suspended from roof support beams. Each panel module has at least one panel module support beam of a suitable length for spanning the transverse direction between the roof support beams. Depending downwardly from the panel module support beam(s) are frame suspension means suspending a refractory support frame. The refractory bricks are suspended from the refractory support frame. One important feature of this invention is that at least one end of the refractory support frame beneath the roof support beam has an extendable and retractable refractory support frame portion. When that frame portion is in retracted position, free passage of the refractory support frame between adjacent roof support beams is possible. When the refractory support frame has been lowered to a position beneath the roof support beams and the extendable and retractable support frame portion is placed in extended position, it provides refractory brick suspension beneath the roof support beams.

The refractory support frame according to this invention provides for suspension of refractory bricks beneath the roof support beams and to a position in proximity to adjacent roof panel modules. The refractory support frame of this invention also allows different types of refractory bricks to be suspended within the same roof panel module.

An object of the present invention is to provide an improved refractory suspended roof construction for high temperature industrial furnaces which affords easier construction and reduced maintenance as compared to present suspended refractory roofs.

Another object of this invention is to provide a suspended panelized roof construction for high temperature furnaces wherein different types of refractory bricks may be suspended in different panels or different types of bricks may be suspended within the same panel.

Still another object of this invention is to provide a suspended roof construction for industrial furnaces which is easy to repair.

Yet another object of this invention is to provide a suspended roof construction for industrial furnaces which have multiple roof panels, each of which may be easily lowered or raised between adjacent support beams and provide means for suspending bricks in the spaces between adjacent roof panels.

It is another object of this invention to provide roof panel frames for suspended refractory roof construction which have extendable and retractable hanger supports for suspending bricks in spaces between adjacent roof panels.

BRIEF DESCRIPTION OF THE DRAWINGS

The above and other advantages and objects of the invention will become more apparent to one skilled in the art upon reading the following disclosure when taken with the drawings showing certain preferred embodiments in which.

DESCRIPTION OF PREFERRED EMBODIMENTS

Figure 1:
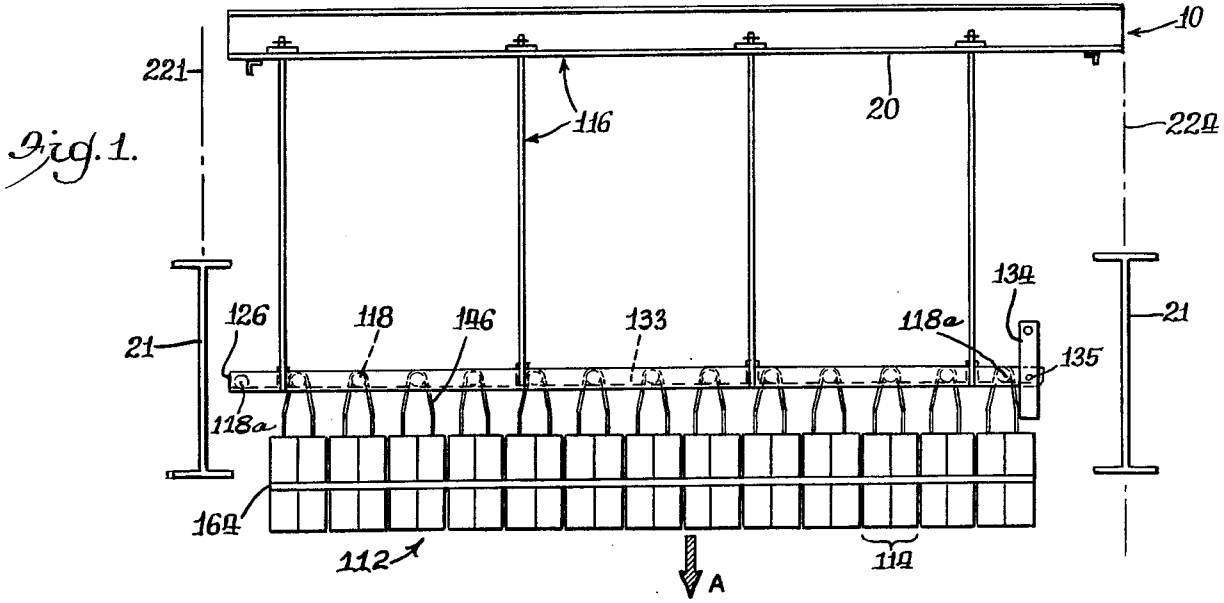
FIG. 1 is an elevation view of one embodiment of roof construction of this invention showing a roof panel unit being lowered between two spaced support beams.
Figure 2:
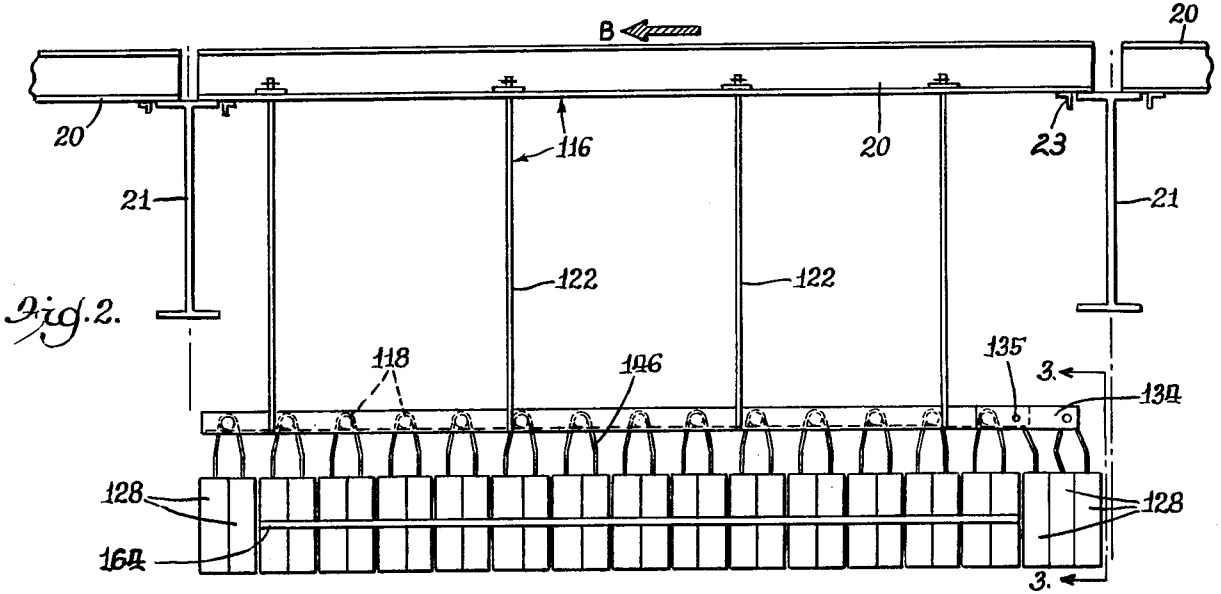
FIG. 2 is an elevation view of the roof construction of FIG. 1 suspended in place from the support beams with end bricks suspended from the extendable support frame.
Figure 3:
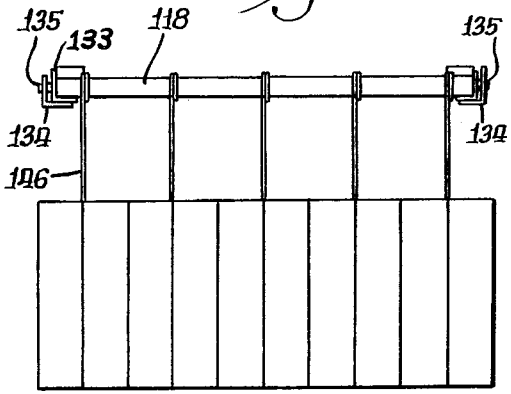
FIG. 3 is an end view of the roof panel unit of FIG. 1.
Figure 4:
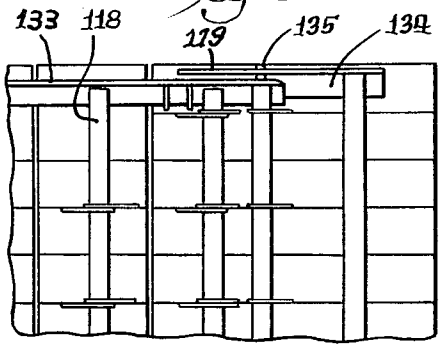
FIG. 4 is a partial top view of the extendable support frame shown in FIGS. 1–3.

FIGS. 1 through 4 show one embodiment of suspended roof construction of this invention showing a single roof panel module 10 made up of refractory bricks as shown in U.S. Pat. No. 4,073,243. Roof panel module 10 has suspension means 116 comprising module support beam 20 of a length spanning the transverse distance between roof support beams 21 and frame suspension means 122 for suspension of a refractory support frame depending downwardly from panel module support beam 20. In the embodiment shown in FIGS. 1 through 4, the refractory support frame has substantially parallel support members 133 and transverse hanger supports 118 which hold refractory brick hangers 146. In the embodiment shown in FIGS. 1 through 4, refractory frame support members 133 are structural angles with an upstanding leg and an inwardly extending hanger support leg, as best shown in FIG. 3, transverse hanger supports 118 resting upon the inwardly extending hanger support leg. In this embodiment of construction, the end transverse hanger supports 118*a* are fixedly attached to the rigid portions of refractory frame support members 133 to provide rigidity to the refractory frame support while internal transverse hanger supports 118 may be adjustable and supported by resting upon the inwardly extending hanger support leg of the structural angle of the refractory frame support members. This flexibility of internal transverse hanger support allows different types of refractory brick to be suspended from the refractory frame support.

The substantially parallel support frame members 133, in at least one end portion, comprise extension and retraction means forming an extendable and retractable refractory support frame end portion. The frame end portion in retracted position, as shown in FIG. 1, allows passage of the refractory support frame between adjacent roof support beams 21 and in extended position, as shown in FIG. 2, provides refractory brick suspension beneath the roof support beams 21 to a proximity to an adjacent roof panel module. While each end of the refractory frame may have a similar extension and retraction means, it is preferred that only one end of the refractory support frame have the extension and retraction means. As best seen in FIGS. 1 and 2, the right-hand end of refractory frame support members 133 have pivotable extension and retraction means. As shown, structural angles 134 are pivotally attached to structural angles 133 by pivot pin 135. Angles 134 are mounted outside the end region of angles 133 and have at least one extension transverse hanger support 118 for support of refractory brick hangers beneath roof support beam 21. Extension and retraction angles 134 have overlap portion 119 which overlap angles 133 to provide support for the weight on the extension transverse hanger support.

Refractories 114 making up refractory panel 112 may be suspended from hanger supports 118 exterior to the furnace and for convenience strapped with strap 164. Extension means 134 is shown in retracted position in FIG. 1 in which roof panel 10 with refractory panel 112 and the refractory support frame may be lowered between adjacent roof support beams 21. The roof panel module is lowered in the direction shown by arrow A in FIG. 1 and when in lowered position may be shifted horizontally in the direction indicated by arrow B in FIG. 2 so that the module support beam 20 rests upon adjacent roof support beams 21. Guides 23 may be used to guide panel module support 20 beam into the proper location. After being positioned upon adjacent roof support beams 21, extension means 134 may be pivoted to the position shown in FIG. 2. End refractory bricks 128, as shown in FIG. 2, on both ends of the refractory panel assembly may be suspended from the refractory support frame substantially filling the space between the center lines 221 and 224 of adjacent roof support beams 21. The same type of refractories as used in the major portion of the refractory panel structure may be used in these end portions or filler refractory bricks may be used as necessary.

Figure 5:
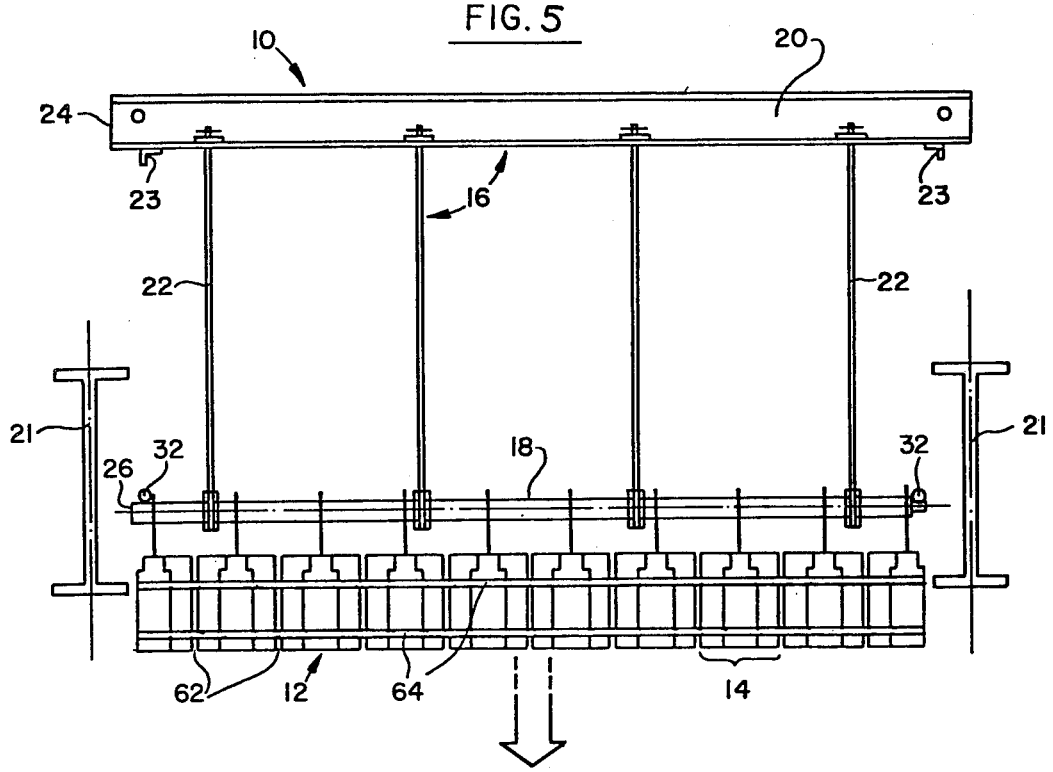
FIG. 5 is an elevation view of another embodiment of roof construction of this invention showing a roof panel unit being lowered between two spaced support beams.
Figure 6:
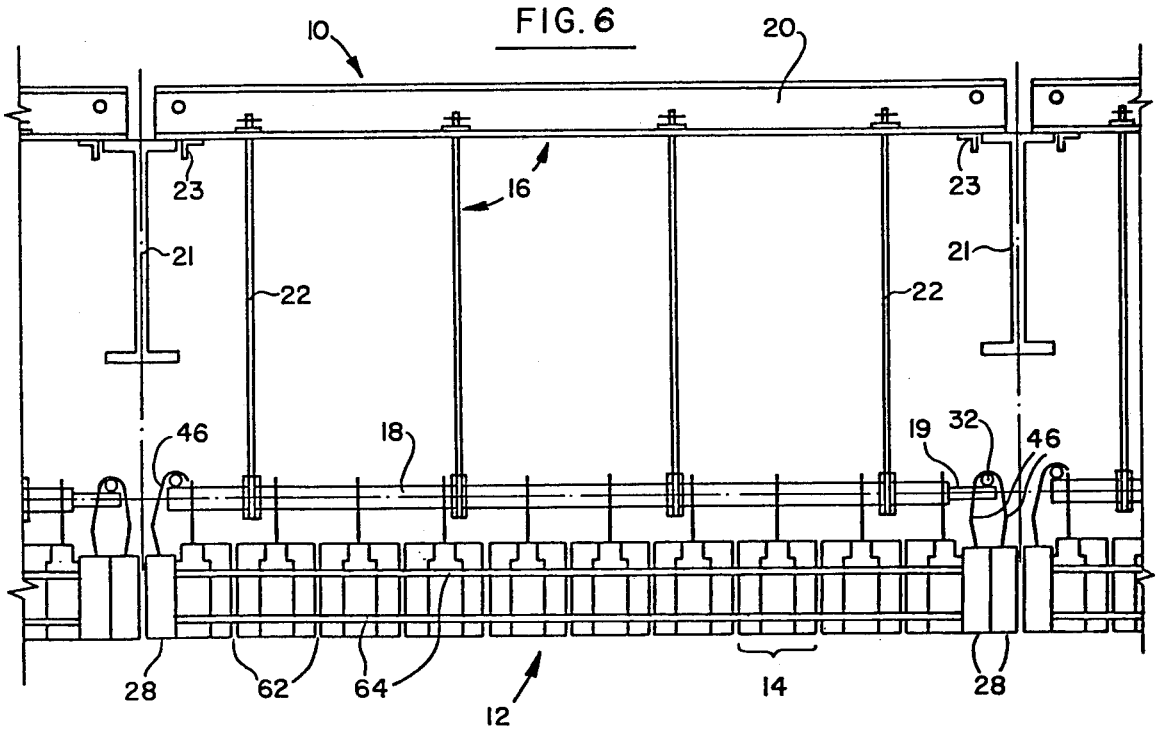
FIG. 6 is an elevation view of the roof construction of FIG. 5 suspended in place from the support beams with end bricks suspended from the extendable support frame.
Figure 7:
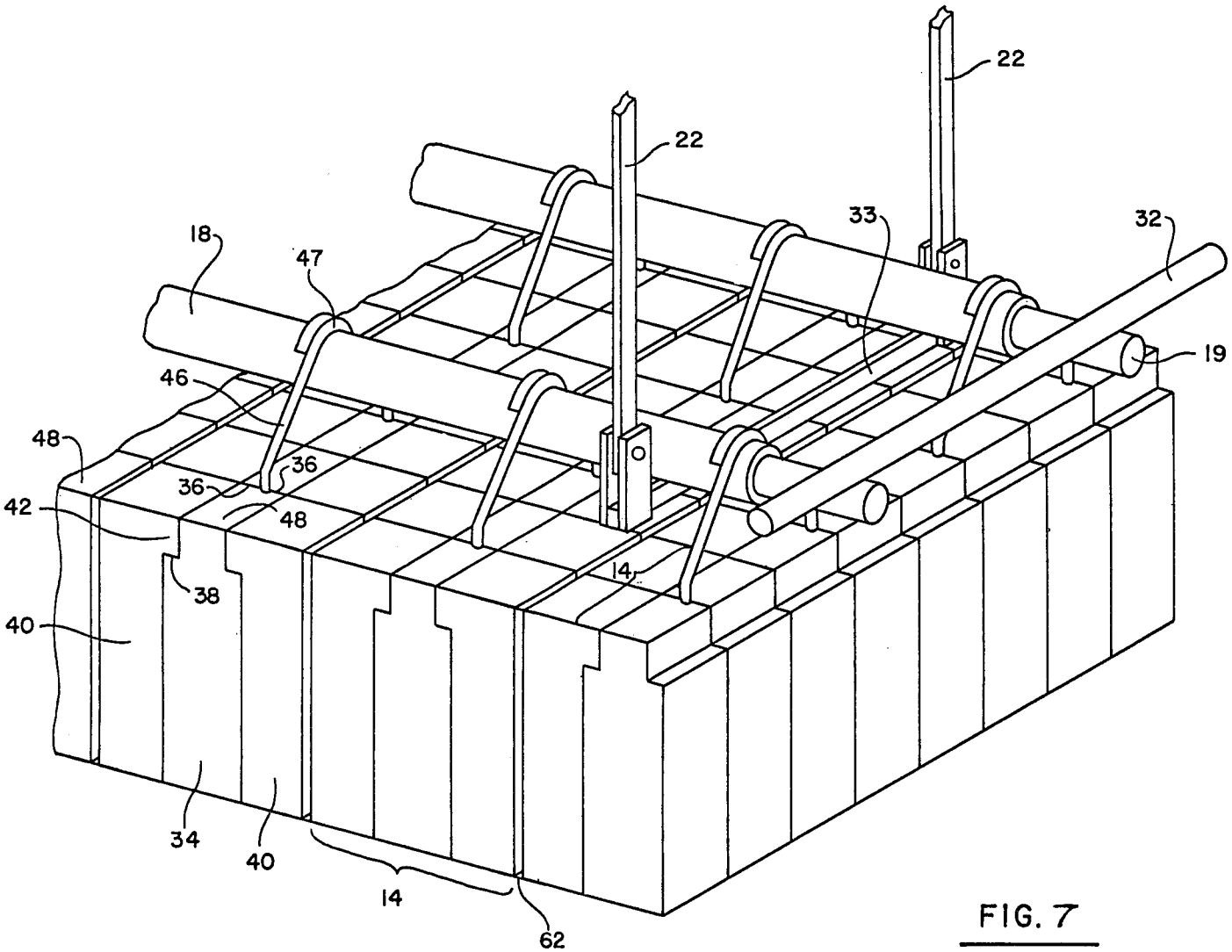
FIG. 7 is a perspective view of a roof panel unit as shown in FIG. 5.

FIGS. 5 through 7 show another embodiment of this invention using a different refractory support frame and differently shaped and differently suspended refractory bricks than described with respect to FIGS. 1 through 4. In this embodiment, suspended roof construction module 10 for a high temperature furnace also comprises at least one panel 12 of roof assembly units 14 suspended by suspension means 16 from structural support frame 21. Suspension means 16 includes cross beam 20 and suspension wires or rods 22 suspending refractory support frame hanger tubes 18. Any suitable configuration or design for suspension means 16 may be used in the suspended roof construction of this invention so long as it provides suspension of the refractory support frame from structural support frame 21. Refractory support frame hanger tubes 18 have extension and retraction means comprising telescoping hanger end 19 on at least one end which may be extended after installation, as shown in FIG. 6.

The entire module 10 beneath cross beam 20 with retracted hanger end 19 may be lowered between two spaced structural support frame beams 21. Hanger tubes 18 may be offset, as shown in FIGS. 5 and 6, toward end 24 of cross beam 20 by an amount of about the same as the projection of the flanges of I beam 21 from its web. In such case, when panel 12 with hanger tubes 18 is lowered beneath structural support frame 21, cross beam 20 may be shifted, to the left as shown in FIGS. 5 and 6, and centered upon structural support frame 21, moving end 26 of hanger tube 18 partially beneath structural support frame 21. This is particularly suitable when telescoping hanger 19 is located at only one end of hanger tube 18. It is apparent that hanger tubes 18 may be centered with respect to cross beam 20 and telescoping hangers 19 may be extended from each end of hanger tube 18. Cross beam 20 may be secured to structural frame 21, if desired. Guides 23 are useful to center cross beam 20 with respect to structural frame 21. End bricks 28 may be suspended from cross bars 32 on fixed end 26 and telescoping hanger 19 by hanger rods 46 after panel 12 is lowered into place and telescoping hanger 19 is extended as shown in FIG. 6. End bricks 28 substantially fill the area between adjacent panels 12 beneath structural support frame 21.

Entire panel 12 may be easily removed by removing end bricks 28, retracting telescoping hanger end 19, and raising suspension means 16 and panel 12. In this manner, replacement or repair may be made to module sections of refractory bricks and metallic hangers from the outside of the furnace, without completely shutting down the furnace.

Suspension rube 18, which is shown in more detail in FIG. 7, may include telescoping hangers 19 on one or both ends. Telescoping hangers 19 may telescope inside of or over the outside of suspension tube 18. Suspension tubes 18 are held in substantially parallel spaced relation to each other by transverse rods 32 secured at or near opposite ends. Suspension wires or rods 22 may be secured to intermediate cross rods 33, or any other suitable means may be used to suspend roof panel 12 from cross beam 20.

Details of the roof assembly units 14 making up suspended roof panel 12 are shown in FIG. 7. Each roof assembly unit 14 includes two refractory carrier bricks 34 having a generally rectangular configuration. The first side 36 of the two carrier bricks 34 are adjacent to each other. At least one of the second and fourth sides adjacent first side 36 have shoulder means 38 extending from their upper portion. Carrier brick 34 has shoulder 38 extending from each the second and fourth sides. Carrier bricks having a second or fourth side at the edge of a panel 12 of roof assembly units 12 may have that side flat. The third side of the carrier brick, opposite the first side, is flat.

At least one refractory filler brick 40 is supported by shoulder 38. Fillter brick 40 has a generally rectangular configuration with supporting lug 42 extending from one face thereof for engagement with shoulder means 38.

An adjacent pair of carrier bricks 34 in assembly unit 14 is supported by a hanger in supporting engagement with the first sides of adjacent carrier bricks at one end as more fully described in U.S. Patent 4,073,243 and hooks over hanger tube 18 by hook 47 at the other end. Any suitable hanger capable of suspending carrier bricks 34 in desired relation may be used in the roof assembly units of this invention.

The top surfaces 48 of carrier bricks 34 and filler bricks 40 lie in a substantially flat, common plane, as shown in FIG. 7.

It is shown in FIG. 7 that each roof assembly unit 14 includes two carrier bricks 34, and may include two or four filler bricks 40, depending upon whether the assembly unit is an edge unit along an edge transverse to the hanger tubes or an edge unit along the edge parallel to the hanger tubes, or an interior unit. Thus, up to six bricks may be supported by a single hanger rod 46 in each roof assembly unit 14. The flat top surface 48 and reduced number of hanger rods 46 provide a cold face surface of the furnace which is easy to clean.

Panel module 12 of multiple roof assembly units may be constructed by securing a plurality of assembly units 14 to hanger tubes 18 and separating some or all of the filler bricks 40 of adjacent assembly units 14 with pack expansion material 62, as shown in FIGS. 5 and 6. The panel module may be secured together with one or more strapping bands 64. Pack expansion material 62 may be alumina silica felt, or any other suitable material.

From the above description, it is readily apparent that any number of support beams may be used dependent upon the width of the panel module. It has been shown that a refractory support frame comprising at least two substantially parallel support members with at least one end of the support members comprising extension and retraction means forming an extendable and retractable refractory support frame end portion has been provided which allows great flexibility in modular suspended roof construction. One embodiment shown in FIGS. 1 through 4 provides for suspension of refractory bricks from cross members between the parallel support members of the refractory support frame, while the embodiment shown in FIGS. 5 through 7 suspend refractory bricks from the parallel support members themselves and cross bars of end portions. An important feature of this invention is the extendable and retractable refractory support frame end portion which in retracted position, allows passage of the refractory support frame between adjacent roof support beams and in extended position provides refractory brick suspension beneath the roof support beams to a proximity to an adjacent roof panel module. It is thus apparent to one of skill in the art that a wide variety of roof panel modules may be made available to fit various suspended roof dimensions. Also, it is readily apparent that a wide variety of refractory brick suspension devices may be used in the suspended roof construction according to this invention. Another feature of this invention is that different types of refractories may be used in different roof panel modules for varying requirements of different areas of the suspended roof and that different types of refractories may even be used in the same roof panel module. As shown in the drawings, suspended roofs having a flat cold side may be obtained with a minimum number of hanger rods as shown in FIGS. 1 through 7 or flat cold surfaces may be obtained providing maximum ease of repairability by removal of as few as two refractory bricks as shown in the construction of FIGS. 1 through 4.

The roof panel modules according to this invention, may be fabricated away from the furnace and the completed panel transported to the furnace site and installed by lowering through the structural support frame of the furnace roof. The suspended roof construction of this invention may be installed and repaired from the cold side of the furnace by lowering or lifting panels of preassembled bricks between the structural support frame of the furnace. Repair of small areas may also be easily achieved from the cold side of the furnace by replacement of a small number of refractory bricks in the panel module, the number of refractory bricks necessary to be replaced depending upon the refractory hanger arrangement. Repairs may be quickly effected to an entire section of the furnace roof by replacing entire panel modules. An easily fabricated, easily maintained and easily repaired suspended roof construction is provided for high temperature furnaces according to this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In suspended roof construction for high temperature furnaces having a plurality of roof panel modules suspended from roof support beams, each said panel module comprising: at least one panel module support beam of a length spanning the transverse distance between said roof support beams; frame suspension means depending downwardly from said panel module support beam(s); refractory support frame suspended by said frame suspension means, said refractory support frame comprising at least two substantially parallel support members at least one end of said support members comprising extension and retraction means comprising pivot means forming an extendable and retractable refractory support frame end portion, said frame end portion in retracted position allowing passage of said refractory support frame between adjacent roof support beams and in extended position providing refractory brick suspension beneath said roof support beams to a proximity to an adjacent roof panel module; and carrier refractory bricks suspended from said refractory support frame, said carrier refractory bricks supporting adjacent filler bricks.

2. In suspended roof construction of claim 1 wherein said refractory frame support members have transverse hanger supports for support of refractory brick hangers.

3. In suspended roof construction of claim 2 wherein said refractory frame support members are structural angles with an upstanding leg and an inwardly extending hanger support leg, said transverse hanger supports resting upon said inwardly extending hanger support leg.

4. In suspended roof construction of claim 3 wherein internal transverse hanger supports are adjustable along said hanger support leg.

5. In suspended roof construction of claim 4 wherein internal transverse hanger supports are spaced at different distances for suspension of different configurations of refractory bricks within the same roof panel module.

6. In suspended roof construction of claim 1 wherein said refractory frame support members are tubular members having transverse supports in their end regions.

7. In suspended roof construction of claim 6 wherein said extension tubular members are joined by a transverse support in their end regions.

8. In suspended roof construction of claim 7 wherein said refractory bricks are suspended from said tubular frame support members and in said end regions from said transverse supports.

9. In a refractory brick roof panel module, a plurality of said roof panel modules suspended from roof support beams forming a suspended refractory roof for a high temperature furnace, said panel module comprising a refractory support frame, said refractory support frame comprising at least two substantially parallel support members, at least one end of said support members comprising extension and retraction means comprising pivot means forming an extendable and retractable refractory support frame end portion, said frame end portion in retracted position allowing passage of said refractory support frame between adjacent roof support beams and in extended position providing refractory brick suspension beneath said roof support beams to a proximity to an adjacent roof panel module, and carrier refractory bricks suspended from said refractory support frame, said carrier refractory bricks supporting adjacent filler bricks.

10. In a refractory brick roof panel module of claim 9 wherein said refractory frame support members have transverse hanger supports for support of refractory brick hangers.

11. In a refractory brick roof panel module of claim 10 wherein said refractory frame support members are structural angles with an upstanding leg and an inwardly extending hanger support leg, said transverse hanger supports resting upon said inwardly extending hanger support leg.

12. In a refractory brick roof panel module of claim 11 wherein internal transverse hanger supports are adjustable along said hanger support leg.

13. In a refractory brick roof panel module of claim 12 wherein internal transverse hanger supports are spaced at different distances for suspension of different confirugations of refractory bricks within the same roof panel module.

14. In a refractory brick roof panel module of claim 9 wherein said refractory frame support members are tubular members having transverse supports in their end regions.

15. In a refractory brick roof panel module of claim 14 wherein said extension tubular members are joined by a transverse support in their end regions.

16. In a refractory brick roof panel module of claim 15 wherein said refractory bricks are suspended from said tubular frame support members and in said end regions from said transverse supports.

17. In suspended roof construction for high temperature furnaces having a plurality of roof panel modules suspended from roof support beams, each said panel module comprising: at least one panel module support beam of a length spanning the transverse distance between said roof support beams; frame suspension means depending downwardly from said panel module support beam(s); refractory support frame suspended by said frame suspension means, said refractory support frame comprising at least two substantially parallel support members which are structural angles with an upstanding leg and an inwardly extending hanger support leg and have transverse hanger supports for support of refractory brick hangers resting upon said inwardly extending hanger support leg, at least one end of said support members comprising extension and retraction means forming an extendable and retractable refractory support frame end portion comprising structural angles pivotally mounted outside the end region of said frame support member structural angles and having at least one extension transverse hanger support for hanging refractory bricks beneath said roof support beams, said frame end portion in retracted position allowing passage of said refractory support frame between adjacent roof support beams and in extended position providing refractory brick suspension beneath said roof support beams to a proximity to an adjacent roof panel module; and carrier refractory bricks suspended from said refractory support frame, said carrier refractory bricks supporting adjacent filler bricks.

18. In suspended roof construction of claim 17 wherein said extension and retraction means structural angles overlap said refractory frame support member structural angles to provide support for weight on said extension transverse hanger support.

19. In suspended roof construction of claim 17 wherein internal transverse hanger supports are adjustable along said hanger support leg.

20. In suspended roof construction of claim 19 wherein said extension and retraction means structural angles overlap said refractory frame support member structural angles to provide support for weight on said extension transverse hanger support.

21. In a refractory brick roof panel module, a plurality of said roof panel modules suspended from roof support beams forming a suspended refractory roof for a high temperature furnace, said panel module comprising a refractory support frame, said refractory support frame comprising at least two substantially parallel support members which are structural angles with an upstanding leg and an inwardly extending hanger support leg and have transverse hanger supports for support of refractory brick hangers resting upon said inwardly extending hanger support leg, at least one end of said support members comprising extension and retraction means forming an extendable and retractable refractory support frame end portion comprising structural angles pivotally mounted outside the end region of said frame support member structural angles and having at least one extension transverse hanger support for hanging refractory bricks beneath said roof support beams, said frame end portion in retracted position allowing passage of said refractory support frame between adjacent roof support beams and in extended position providing refractory brick suspension beneath said roof support beams to a proximity to an adjacent roof panel module, and carrier refractory bricks suspended from said refractory support frame, said carrier refractory bricks supporting adjacent filler bricks.

22. In a refractory brick roof panel module of claim 21 wherein said extension and retraction means structural angles overlap said refractory frame support member structural angles to provide support for weight on said extension transverse hanger support.

23. In a refractory brick roof panel module of claim 21 wherein internal transverse hanger supports are adjustable along said hanger support leg.

24. In a refractory brick roof panel module of claim 23 wherein said extension and retraction means structural angles overlap said refractory frame support member structural angles to provide support for weight on said extension transverse hanger support.

* * * * *